United States Patent [19]

Plunkett et al.

[11] Patent Number: 4,629,119

[45] Date of Patent: Dec. 16, 1986

[54] ELECTROSTATIC ISOLATION APPARATUS AND METHOD

[75] Inventors: Robert T. Plunkett; Ion I. Inculet, both of London, Canada

[73] Assignee: Nordson Corporation, Amherst, Ohio

[21] Appl. No.: 574,277

[22] Filed: Jan. 26, 1984

[51] Int. Cl.[4] ..... B05B 5/00

[52] U.S. Cl. ..... 239/63; 239/3; 239/101; 239/690

[58] Field of Search ..... 239/101, 93, 102, 103, 239/121, 73, 74, 690, 693, 699, 3, 63

[56] References Cited

U.S. PATENT DOCUMENTS

| | | | |
|---|---|---|---|
| 1,707,696 | 3/1929 | Walker | 239/121 |
| 2,673,232 | 3/1954 | Silsby, Jr. | 174/15 R |
| 2,812,612 | 11/1957 | Vang | 239/102 X |
| 3,098,890 | 7/1963 | Peterson | 174/8 |
| 3,122,320 | 2/1964 | Beck et al. | 239/3 |
| 3,189,280 | 6/1965 | Drayer | 239/102 X |
| 3,360,035 | 12/1967 | Van Loo et al. | 165/104.27 |
| 3,583,634 | 6/1971 | Sheetz | 239/103 |
| 3,656,171 | 4/1972 | Robertson | 239/690 X |
| 3,848,118 | 11/1974 | Rittberg | 239/101 |
| 3,892,357 | 7/1975 | Tamny | 239/706 |
| 3,893,620 | 7/1975 | Rokadia | 239/3 |
| 3,905,550 | 9/1975 | Rokadia et al. | 239/690 X |
| 3,929,286 | 12/1975 | Hastings et al. . | |
| 3,933,285 | 1/1976 | Wiggins | 222/56 |
| 3,934,055 | 1/1976 | Tamny | 427/8 |
| 3,971,337 | 7/1976 | Hastings . | |
| 4,017,029 | 4/1977 | Walberg | 239/695 |
| 4,020,866 | 5/1977 | Wiggins | 137/592 |
| 4,077,227 | 3/1978 | Larson | 62/74 |
| 4,085,892 | 4/1978 | Dalton | 239/907 |
| 4,097,680 | 7/1978 | Clavell, Jr. | 174/8 |
| 4,166,948 | 9/1979 | Steffen | 250/214 P |
| 4,204,844 | 5/1980 | Pilat | 55/10 |
| 4,413,788 | 11/1983 | Schaefer et al. | 239/702 |

FOREIGN PATENT DOCUMENTS

| | | | |
|---|---|---|---|
| 574619 | 3/1958 | Italy | 239/103 |
| 1395486 | 5/1975 | United Kingdom | 239/690 |
| 665855 | 6/1979 | U.S.S.R. | 239/101 |

*Primary Examiner*—Jeffrey V. Nase
*Assistant Examiner*—Kevin Patrick Weldon
*Attorney, Agent, or Firm*—Wood, Herron & Evans

[57] ABSTRACT

An isolator for electrically isolating an electrostatically charged, electrically conductive coating material supply line from a grounded source of conductive coating material while continuously transferring coating material from the source to the supply line. The isolator includes a receptacle for a charged coating material reservoir and an insulative housing surrounding the charged coating material receptacle. The coating material in the receptacle is fed through an outlet to the supply line for an electrostatic coating device, which is electrostatically charged. Due to the conductive nature of the coating material, the electrostatic potential at the coating device is coupled through the coating material, and the reservoir of coating material in the receptacle is likewise electrostatically charged. The coating material from the grounded coating material source is coupled to a grounded nozzle assembly in a housing which is positioned above the charged coating material receptacle. The grounded coating material nozzle assembly includes a nozzle in a bottom portion thereof, and the coating material in the grounded nozzle assembly is mechanically vibrated to produce a pulsed jet droplet flow of electrostatic coating material from the nozzle into the charged coating material receptacle. A grounded metallic shield is mounted in the housing between the two coating material receptacles to substantially electrically shield the grounded nozzle assembly from electrical potentials below the shield, including the electrical potential of the charged coating material reservoir. The shield is apertured to permit the passage of the pulsed jet droplet flow of coating material.

82 Claims, 7 Drawing Figures

ELECTROSTATIC ISOLATION APPARATUS AND METHOD

DESCRIPTION OF THE INVENTION

This invention relates generally to electrostatic isolation systems and more particularly concerns an electrical isolation apparatus and method for transferring liquid from a source at one electrical potential to a supply at a second electrical potential, while maintaining electrical isolation therebetween. The invention is disclosed particularly in relation to an electrical isolator for use in a system for electrostatically applying electrically conductive coating materials on a continuous basis wherein exposed elements of the isolator are electrically grounded to avoid shock hazards from accidental contact with exposed portions of the isolator.

Typically, in electrostatic coating systems, a highly charged coating material is applied to a grounded, electrically conductive object to be coated. Illustrative is an electrostatic spray painting system in which paint is supplied to a spray gun from a paint reservoir and sprayed, in an electrically charged state, onto a grounded object such as a car body or bicycle frame. The paint is electrically charged by an electrode located, for example, at the spray gun.

If the paint is substantially non-conductive, it can be supplied to the spray gun from a large grounded bulk supply container through an insulative hose, and the column of paint in the supply hose will not conduct electrostatic charge away from the gun electrode. Therefore, such spray painting can be conducted on a continuous basis, and the grounded bulk supply tank can be refilled as necessary without interrupting the spray painting operation.

However, water, methanol, and other high polar solvent-based paints, as well as "metallic" paints, are generally conductive. With the paint at the spray gun at a high electrostatic potential, which in present systems can be as high as 125,000 volts, a conductive paint provides a conductive path through the paint line from the gun to the paint tank. In order to maintain the system at a high potential, it is therefore necessary to isolate the paint supply from ground.

Supplying the paint to the spray gun from a large, electrostatically charged reservoir, which is isolated from ground, has a number of disadvantages. In such an arrangement, the paint tank can only be refilled with the system turned off, interrupting the spray painting operation. In addition, the paint lines and the tank must be surrounded by protective fencing or the like to prevent accidental contact therewith. Further, the paint lines and the tank contribute to the total capacitance of the spray painting system, greatly increasing the discharge energy available if the spray gun is accidentally contacted. Such accidental contact would therefore result in an increased risk of explosion and an increased hazard to the operator of the spray gun or to other personnel.

In order to overcome these disadvantages, a number of different types of electrical isolators have been proposed which would serve to electrically isolate a bulk paint supply from an electrostatic spray gun. Such isolators that permit operation on a continous basis generally take the form of a first electrostatically charged tank which feeds paint to the gun and a second, grounded, bulk supply tank from which paint is dispensed into the first tank via a spray head or the like to avoid electrical continuity between the grounded bulk supply and the charged tank of paint connected to the gun. Such systems do permit continuous operation and substantially reduce the capacitance of the charged paint portion of the system. However, in such systems, the charged supply portion of the system must still be protected from accidental contact such as by screening or fencing.

In one system, which is disclosed in U.S. Pat. Nos. 3,892,357 and 3,934,055, electrically conductive paint is supplied through a hose to a gun from a paint tank which is enclosed within an insulative grounded housing. The top of the tank is open, and conductive paint from a grounded bulk supply is sprayed into the tank through a spray nozzle within, and electrically connected to, the grounded housing. The use of a spray nozzle produces a discontinuous "flow" of paint into the tank, providing electrical isolation between the charged paint in the tank and the nozzle and bulk supply container.

In the isolator disclosed in the above-mentioned patents, the charged paint tank is spaced inwardly from the walls of the housing and supported therein on an insulative stand. A substantial flow of dry gas is supplied over the surfaces of the insulative stand through the space between the tank and the inner wall of the housing to prevent deposition of an electrically conductive paint film thereon, which if permitted to accumulate would provide a conductive path between the electrostatically charged inner tank and the outer, electrically grounded, housing. The large quantities of dry gas passed through the interior of this prior isolator, however, evaporated large quantities of paint solvent, resulting in degradation of the properties of the paint.

It is one aim of the present invention, therefore, to provide an isolator for an electrostatic spray coating system of the foregoing type which permits continuous operation of the system while preventing accidental contact with the charged coating material in the isolator, without the degradation of the coating material.

More generally, it is an aim of the present invention to provide an electrostatic isolation system for transferring liquid from a source which is at one electrical potential to a supply at a second electrical potential, substantially different from the first potential, while maintaining electrical isolation between the source and the supply.

In the course of the development of the present invention, it was recognized that one of the causes of paint film build-up in the prior patented isolator was induction charging of the spray droplets at the nozzle. The electrostatic potential on the charged paint in the paint container, as well as the potential on the walls of the paint container itself, produce an electrostatic field; and an electrostatic charge (of opposite sign to that of the charged paint) is induced on the spray droplets as they are formed in the vicinity of the nozzle. These oppositely charged droplets are subsequently electrostatically attracted to the charged surfaces in the isolator such as the walls of the charged paint tank and the insulative stand.

Consequently, in accordance with one aspect of the present invention, an isolator is provided with shielding in which droplets of liquid are formed substantially in the absence of an electrostatic field, preventing the induction of electrical charge on the droplets.

Further in the course of the development of the present invention, it was recognized that the spray nozzle utilized in the prior patented isolator inherently produces a "fog" of extremely small "droplets". This results in small particle drift to the walls of the isolator. This small particle drift is found not only in regard to spray nozzles, as used in the patented isolator, but also with regard to rotary atomizers and like devices.

In accordance with a further aspect of the invention, an isolator is provided in which a stream of large droplets is supplied from a nozzle (which is coupled to a bulk supply) to a liquid reservoir at a substantially different electrical potential from that of the bulk supply. In the illustrated form of the invention, the droplets are formed utilizing a pulsed jet technique wherein uncharged electrostatic coating material which is supplied to the nozzle is mechanically vibrated to form a pulsed jet droplet flow of coating material.

In one embodiment of the invention to be described herein, an isolator for an electrostatic spray painting system includes a high voltage receptacle located beneath a grounded nozzle assembly, with both located inside a housing and electrically separated by a ground shield. Paint is supplied to a relatively small nozzle chamber, or reservoir, at a desired flow rate from a bulk paint supply tank. The nozzle chamber is defined, at one wall, by a membrane which is vibrated at a frequency, and with a force, selected to produce a stream of large droplets, which form below the nozzle. The droplet frequency is established by the membrane vibration frequency, and the droplet size is dependent upon that frequency and the flow rate into the nozzle chamber.

The large droplets in the droplet stream falling from the nozzle are formed above the ground shield, fall through an aperture in the ground shield, and drop into the charged paint receptacle in a lower section of the housing. The electrostatic fields created by the high voltage elements, including the charged paint, in the lower section of the housing are shielded from the droplet-forming area below the nozzle by the ground shield. The paint collected in the high voltage receptacle is coupled through a paint outlet to an electrostatic spray gun. The charge on the paint for the spray gun is coupled back to the high voltage receptacle by the paint column between the receptacle and the gun.

Since the pulsed jet droplets are not formed in an electrostatic field, the droplets are uncharged and unaffected by electrostatic forces below the ground shield as the droplets fall into the charged paint receptacle. Since the pulsed jet droplets are large, they are not subject to small particle drift. In addition, since the droplets are large, the surface area per unit mass of paint transferred is reduced from that of smaller droplets, and evaporation of the paint is reduced.

In the illustrated form of the invention, the paint flow from the charged paint receptacle is provided by pressurizing the interior of the housing, which results in paint flow from the paint outlet. In order to purge the small amount of evaporated paint within the housing, a small amount of the dry, pressurized air coupled to the interior of the housing is vented from the housing at a low rate.

Further objects and advantages of the invention, and the manner of their implementation, will become apparent upon reading the following detailed description and upon reference to the drawings, in which.

Figure 1:
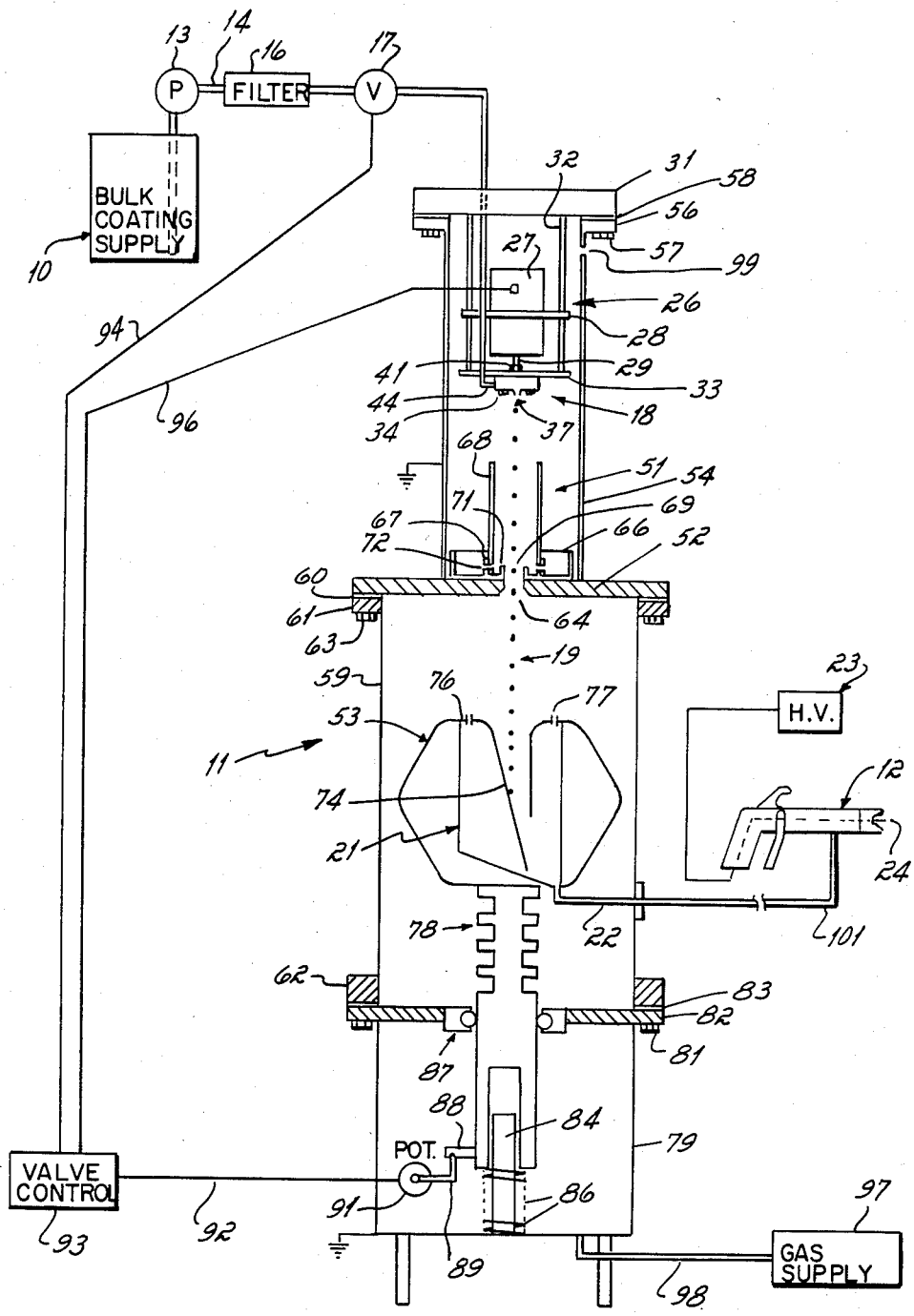
FIG. 1 is a schematic diagram of an embodiment of a coating material spray system incorporating the principles of the present invention.

While the invention is susceptible to various modifications and alternative forms, certain illustrative embodiments have been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

With initial reference to FIG. 1, an electrostatic paint spray coating system includes a bulk coating supply 10 coupled through an isolator 11 to an electrostatic spray gun 12 for electrostatically spray painting objects to be painted. A pump 13 supplies paint from the bulk coating supply tank 10 via a paint inlet line 14 through a filter 16 and an electrically operated valve 17 to a nozzle 18 in the isolator 11. Droplets of paint in a droplet stream 19 formed below the nozzle are collected in a receptacle 21. Paint in the receptable 21 is coupled through a paint outlet line 22 to the gun 12 from which it is sprayed onto objects to be painted. The sprayed paint is charged to a high electrostatic potential by a high voltage supply 23 via a high voltage electrode 24 in the gun 12. The high voltage at the electrode 24 is coupled through the column of paint in the paint outlet line 22 to the paint in the receptacle 21. Therefore, the paint in the receptacle 21 is charged to substantially the same high voltage potential as exists at the electrode 24. This high voltage potential is typically in a range between 30 and 125 kilovolts.

In order to produce the droplet stream 19, the nozzle 18 is incorporated in a vibrator-nozzle assembly 26. The assembly 26 includes a vibrator 27 having a fixed outer housing including an annular plate 28, and a reciprocating piston rod 29. The annular plate 28, and the vibrator housing, are secured to a lid 31 by four vertical support rods 32. The support rods 32 also are attached to, and support, a bottom plate 33 upon which the nozzle 18 is mounted by bolts 34. The lid 31 may be plexiglas or a conductive metal.

The nozzle 18 (FIG. 2) is a generally cylindrical disk defining a nozzle reservoir 36 having a nozzle opening 37 in the bottom thereof. The top wall of the nozzle reservoir 36 comprises a paint receptacle which is defined by a piston 38 and a diaphragm 39 upon which the piston is mounted. The diaphragm is secured between the nozzle 18 and the bottom plate 33.

The piston 38 is connected to the piston rod 29 of the vibrator 27 by a threaded shaft 41, which is threadedly secured at its upper end to the rod 29. The lower end of the threaded shaft 41 is secured to the piston 38, and the diaphragm 39 is secured between the piston 38 and a washer 42 by a nut 43 on the shaft 41. The lower portion of the nozzle reservoir 36 is generally cylindrical and sized to receive the piston 38. The upper portion of the reservoir 36 is frustoconical and contains an opening 46 which communicates with a bore 47 coupled to a paint inlet line 44 from the valve 17. The inlet line 44 is coupled to the nozzle 18 at the bore 47 by a suitable fitting 48.

The vibrator-nozzle assembly 26 functions to produce a pulsed jet droplet flow of uncharged paint emanating from the nozzle opening 37. Pulsed jets break up a fluid by compressing and expanded the fluid stream as it exits from a nozzle. This may be accomplished, for example, by driving the nozzle itself to cause the fluid stream to compress as the nozzle moves downward and then expand as the nozzle moves upward. This compression, expansion effect enhances the droplet formation and can result in very rapid droplet formation. In the presently disclosed form of pulsed jet droplet-forming nozzle, the nozzle remains stationary and the pressure that feeds the pulsed jet is varied sinusoidally by means of the diaphragm 39 at the top of the nozzle chamber 36. The diaphragm is driven by the vibrator 27. The variations in pressure at the nozzle due to the movement of the diaphragm 39 and the piston 38 result in increasing and decreasing flow. The end result is droplet formation in a relatively short distance below the nozzle opening 37.

Advantageously, the paint inlet opening 46 into the nozzle chamber 36 is located to provide partial sealing of this opening by the movement of the piston 38 on each downstroke. In this way, much of the vibration energy which would otherwise travel back through the paint line is conserved. This in turn results in a lower energy requirement for the vibrator in order to form the desired pulsed jet droplet flowstream.

Figure 5:
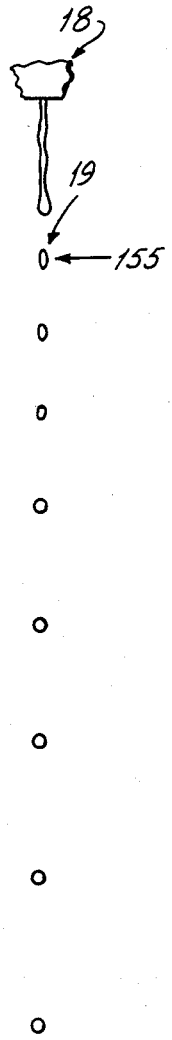
FIG. 5 is an illustration of pulsed jet droplet flow illustrating the separation of droplets in the flow path.

A typical pulsed jet droplet flowstream is illustrated in FIG. 5. Droplet separation occurs relatively near the nozzle, and once each droplet is formed, it maintains its integrity. During proper droplet formation, the droplets occur at a frequency equal to the frequency of oscillation of the vibrator and piston. The size of the droplets is determined by the flow rate of the paint into the chamber 36 through the paint supply lines 44, 47 and the frequency of oscillation. Typical paint droplets may be, for example, on the order of 2–3 mm. in diameter.

The droplet stream 19 falls through a splatter shield 51 and an apertured ground shield 52 into the charged paint receptacle 21, which is inside a high voltage chamber 53. The nozzle 18 and the splatter shield 51 are located within a grounded metallic tube 54 which forms the top section of the housing of the isolator 11. The lid 31 of the isolator, which carries the vibrator-nozzle assembly 26, is secured about its periphery to a flange 56 at the top of the grounded tube 54 by bolts 57. A suitable gasket 58 for air-tight sealing is provided between the flange 56 and the lid 31. The tube 54 is welded about its base to the ground shield 52.

The central portion of the isolator housing is a plexiglas cylinder 59 which includes upper and lower annular flanges 61, 62. The ground shield 52 is attached about its periphery to the annular flange 61 by bolts 63. An annular gasket 60 is received between the ground shield 52 and the top of the plexiglas cylinder 59.

In order to permit passage of the paint droplets from the nozzle 18 to the receptacle 21, the ground shield 52 is apertured, as indicated at 64. In order to prevent paint splatter from the nozzle 18 from entering the isolation area about the high voltage chamber 53, the splatter shield 51 is mounted within the cylinder 54, resting upon the ground shield 52. The splatter shield 51 includes a collecting bowl 66, the outer wall of which is adjacent the inner wall of the tube 54. The bowl 66 is brass, and includes an annular lip 67 within which a vertical guidepipe 68 is soldered. The center of the bowl 66 includes an opening 69 which is aligned with and equal in diameter to the opening 64 in the ground shield 52. The opening 69 is surrounded by a cylindrical wall 71.

In normal droplet production, the droplets are formed above the ground shield and the splatter collecting bowl 66, and the droplets pass through the openings 69 and 64 into the isolation area within the plexiglas cylinder 59. Paint which is not properly aligned to fall through the openings 64 and 69 is collected between the wall 71 of the bowl 66 and the wall of the guidepipe 68. The collected paint is free to pass through openings 72 in the flange 67 into the outer portion of the bowl 66.

The metallic cylinder 54 forming the top section of the isolator housing, the ground shield 52, and the splatter shield 51 are electrically connected together and to earth ground. Therefore, there is substantially no electrostatic field within the cylinder 54 in the area at which droplet formation is taking place. In this way, the droplets of the droplet stream 19 are formed free of electrostatic charge since there is no field to induce a charge at the separation point of the droplets. Consequently, when the droplets in the stream 19 enter the isolation area within the plexiglas cylinder 59, throughout which there exists a relatively strong electrostatic field, the drops are not influenced by the electrostatic forces since the drops are uncharged.

The charged paint cup 21 in which the droplets 19 are collected is mounted within the high voltage chamber 53, which is exteriorly rounded and dimensioned to prevent corona. The charged paint container 21 provides a paint reservoir so that the inflow of paint need not match the outflow through the paint outlet 22. In order to eliminate frothing within the charged paint receptacle 21, the droplets in the droplet stream 19 are received on a sloped wall of a funnel 74 mounted within the receptacle 21. The paint droplets are received within an upper opening in the funnel 74 and flow down the sloped wall into the receptacle 21. The funnel 74 includes an upper flange 76 which partially covers the charged paint container 21 to reduce the amount of evaporation of the paint within the container. The flange 76 includes vent holes 77 to permit the escape of air from the paint receptacle 21 as it fills with paint.

The paint receptacle 21, the funnel 74, and the high voltage chamber 53 are electrically connected and charged in common to the electrostatic potential coupled through the paint column from the gun 12. The high voltage chamber 53 is in turn mounted upon an insulating column 78, the bottom of which extends into the bottom portion of the isolator housing, which is electrically conductive and connected to earth ground. The insulating column 78 therefore provides the requisite electrical isolation between the high voltage chamber 53 and the housing base section 79.

The plexiglas cylinder 59 is mounted on the housing base 79 by bolts 81 securing a flange 82 at the top of the base 79 to the annular flange 62 at the bottom of the plexiglas cylinder. A gasket 83 is secured between the flange 62 and the flange 82.

Although the middle portion of the isolator housing 59 is plexiglas, it would be possible to use a metal cylinder for the central portion of the housing. The metal cylinder would then be electrically grounded and electrically connected to the metallic cylinder 54 and the base 79. If such an electrically conductive cylinder were used in place of the plexiglas cylinder 59, the spacings between the high voltage chamber 53 and the wall of the housing 59 would need to be considerably increased or suitably insulated.

To provide an indication of the level of the paint in the container 21, the container, the high voltage chamber 53, and the insulating column 78 are mounted for vertical movement relative to the isolator housing, with the vertical position of the column and chamber being indicative of the amount of paint in the container. In order to do this, the bottom of the insulating column 78 terminates in a bore which receives a post 84 fixed to the bottom of the housing base 79. A biasing spring 86, bearing between the base 79 and the bottom of the insulating column 78, urges the insulating column 78 upwardly. The upward spring force on the insulating column 78 is opposed by the weight of paint within the container 21 and the weight of the insulating column and the high voltage chamber and the elements mounted therein. To guide the insulating column for vertical movement, the column moves within a bearing assembly 87 mounted in the top of the base 79.

A projection 88 rigidly attached to the bottom portion of the insulating column 78, and vertically movable therewith, is coupled to a lever arm 89 of a potentiometer 91 in order to translate the vertical position of the insulating column into an electrical signal. As the container 21 fills with paint, the insulating column 78 and projection 88 move downwardly, moving the lever arm 89 in a clockwise direction. Conversely, as the paint container 21 empties, the insulating column 78 is urged upwardly by the spring 86, and the lever arm 89 of the potentiometer moves in a counterclockwise direction.

The electrical connections to the potentiometer 91, shown collectively as 92, are coupled to a valve control 93. The valve control 93 opens and closes the valve 17 in the paint inlet line in order to fill the charged paint container 21 as necessary to replace paint used by the gun 12. To do this, the valve control 93 responds to a "low" paint indication from the potentiometer 91 to send a signal on a control line 94 to the valve 17 to open the valve. The valve control 93 also activates the vibrator 27 on a control line 96 to actuate the vibrator-nozzle assembly to produce the pulse jet droplet stream 19.

When the potentiometer 91 indicates a paint "high" level condition, the valve control 93 is responsive thereto to turn off the valve 17 and the vibrator 27. Preferably, the turn off of the vibrator 27 is slightly after the closing of the valve in order to compensate for the electromechanical delay in the valve closure.

In order to supply the paint to the gun 12, the interior of the isolator housing is pressurized by a gas supply 97 coupled to the interior of the base 79 through a hose 98. Since the interior of the isolator is pressurized, paint is supplied through the paint outlet 22 under pressure, and a pump is not needed in the charged paint line. The spraying of paint is then controlled at the gun 12 by opening and closing a valve in the paint line.

In order to slowly purge the interior of the isolator 11 of evaporated paint, a vent 99 is supplied near the top of the housing cylinder 54 in the vicinity of the vibrator-nozzle assembly 26. The requisite pressure for feeding paint to the gun 12 is maintained by suitably setting the pressurized flow from the gas supply 97 to accommodate the small vent opening 99. The gas flow rate may be set to be, for example, sufficient to replenish the atomsphere inside the isolator 11 once per hour. The air in the isolator 11, which becomes humid due to the evaporation of paint, has a lower voltage breakdown point than dry air, and consequenty corona and arcing can occur in the vicinity of the high voltage chamber if the humid air is not purged from the isolator. To best accomplish this, the gas supply 97 should be a source of nitrogen, dry air, sulfur hexafluoride or the like. The isolator atmosphere vented through the opening 99 may, if desired, be collected and exhausted.

Although in the form of the invention illustrated in FIG. 1 the high voltage supply 23 is coupled to an electrode at the gun 12, high voltage may alternatively be provided in the paint outlet line 101, as illustrated in the above-mentioned U.S. Pat. Nos. 3,934,055 and 3,892,357. In addition, the hose 101 from the paint outlet to the gun may include an exterior grounded shield layer as disclosed in the cited patents.

Figure 3:
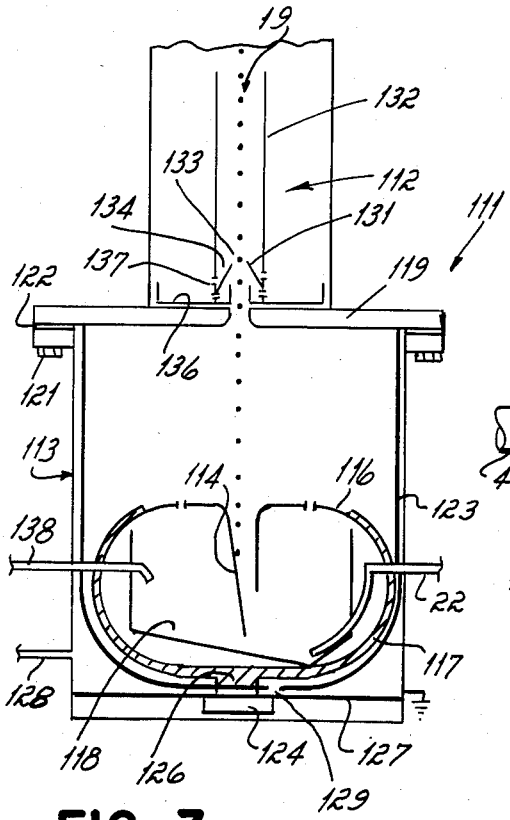
FIG. 3 is a schematic diagram of a second embodiment of an isolator in accordance with the principles of the present invention.

With reference now to FIG. 3, the lower portion of a modified isolator 111 is illustrated which is substantially the same as the isolator 11 of FIG. 1 with regard to the vibrator-nozzle assembly and related components. In addition, the external connections to the spray gun 12, gas supply 97, etc. are the same as for the isolator 11 of FIG. 1. The isolator 111 includes a modified splatter shield 112 and a modified lower housing 113. The droplet stream 19 falls through the modified splatter shield 112 into a high voltage area within the housing 113. The droplet stream is received within a funnel 114 formed in the top portion of a high voltage chamber 116 which carries an insulative coating 117 on the bottom and sides thereof. The droplets 19 contact the funnel 114 along its sloped surface and the paint flows into a container 118 within the high voltage chamber 116.

The lower housing 113 is an electrically grounded metal case which is electrically connected to a ground shield 119 (substantially like the ground shield 52 of FIG. 1) by bolts 121. A suitable gas-sealing gasket 122 is secured between the ground shield 119 and the case 113. In order to further insulate the high voltage chamber 116 from the grounded metal case, an insulating wall 123 is mounted inside the case and spaced inwardly therefrom.

The high voltage chamber 116 is insulatively supported upon a load cell 124 by an insulating column 126, partially formed of the insulator material 117, at the base of the high voltage chamber. The chamber 116 is supported to provide spacing between the exterior of the insulative coating 117 and the insulating wall 123. The load cell 124 provides an indication of the weight of the high voltage chamber, and hence the fill level of the charged paint container 118, which is coupled to a valve control such as the control 93 of FIG. 1. The bottom of the housing 113 includes a metal shield 127 to shield the load cell from the high voltage of the high voltage chamber 116.

As in the case of the isolator 11 of FIG. 1, the interior of the isolator 111 is pressurized through a dry gas inlet 128. Paint flows under the influence of the pressure in the isolator from the bottom of the container 118 through a paint outlet 22 to a spray gun (not shown). Gas flows from the gas inlet 128 through openings 129 in the bottom of the insulating wall 123, between the insulative coating 117 and the insulating wall 123 upwardly through the lower housing 113, and through the upper housing portion of the isolator to a suitable vent, such as the vent 99 of the isolator 11 of FIG. 1.

The modified splatter shield 112 is substantially similar to the splatter shield 51 of the isolator 11, with the addition of a conical shield element 131 mounted in the splatter shield pipe 132. An opening 133 in the top of the conical element 131 is slightly smaller than the openings through the bowl 136 and ground shield 119. Paint which is laterally displaced from the opening 133 falls into a collection area 134 and flows into the bowl 136 through openings 137 in the side of the pipe 132.

The isolator 111 is of reduced height relative to the isolator 11 of FIG. 1 due to the provision of the load cell weight sensing arrangement. In addition, a metal case 113 is utilized for complete grounding of the exterior of the isolator, with the provision of suitable insulation such as 117, 123 within the lower housing 113.

The isolator 111 further includes a solvent flush line 138 which is coupled to a solvent supply when the system is shut down, in order to permit solvent flushing of the paint container 118. The solvent flush may be followed by purging dry air to dry the solvent from the system. In the isolator 11 of FIG. 1, as well as the isolator 111 of FIG. 3, the nozzle and inlet lines may be flushed with solvent by feeding solvent into the paint inlet.

Figure 4:
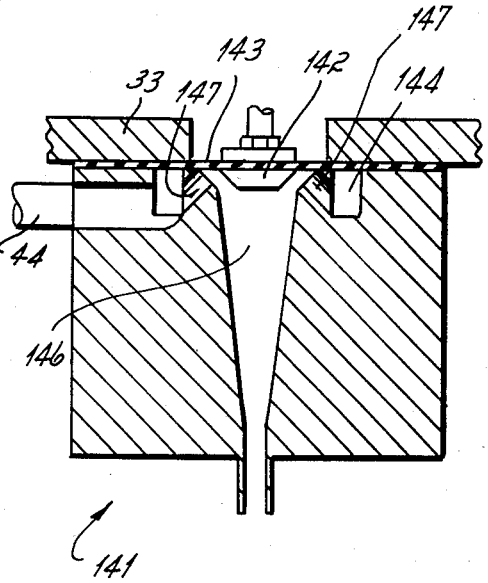
FIG. 4 is an enlarged schematic diagram of an alternative form of the nozzle of the embodiments of FIGS. 1 and 3.

An alternative nozzle configuration is illustrated in FIG. 4. The modified nozzle 141 includes a frusto-conical piston 142 (coupled as before to the vibrator 27) attached to a membrane 143 beneath the bottom plate 33. In the nozzle 141, the paint inlet 44 communicates with an annular feed chamber, or manifold 144 which encircles the top of the nozzle opening 146. Instead of a single bore communicating with the nozzle chamber 146, eight radially spaced bores 147 communicate inwardly from the manifold 144 to the nozzle chamber 146. The eight radially spaced bores 147 provide greater uniformity in the supply of paint to the nozzle chamber 146. As in the case of the nozzle of FIG. 2, the downward movement of the piston 142 partially closes the bores 147 to reduce the vibratory energy dissipated through coupling of mechanical energy back to the paint inlet.

Figure 2:
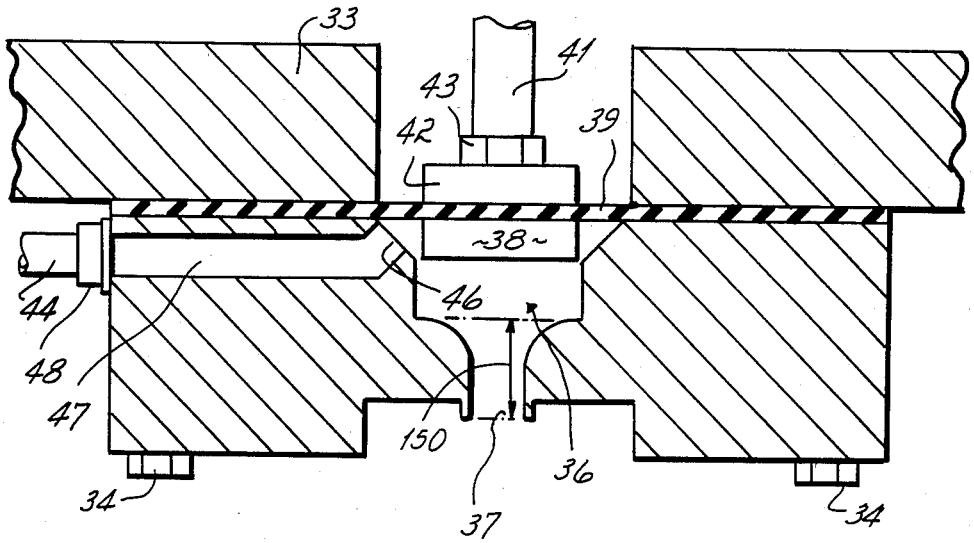
FIG. 2 is an enlarged schematic diagram of the nozzle of the isolator of the system of FIG. 1.

The production of a pulsed jet droplet flow of coating material shall now be described in further detail with regard to a particular nozzle size and configuration. In an exemplary use of a nozzle of the type illustrated in FIG. 2, the nozzle chamber had a depth, below the piston in its "at rest" state as shown in FIG. 2, of three mm. and a piston thickness of 2 mm. The nozzle diameter was 2.78 mm. at the outlet opening, and the length 150 of the outlet opening was about 4.73 mm. For a liquid having a Zahn #2 cup viscosity of 42 seconds, and at a liquid flow rate into the nozzle of 300 milliliters per minute, the breakup point of the droplet stream occurred at a point between 7 and 8 cm. below the nozzle over a range of vibrator frequencies from 100 Hz. to 375 Hz. At 400 Hz., the breakup point occurred between 11 and 12 cm. below the nozzle. The breakup point of the droplet flow in FIG. 5 is shown at 155.

For the same nozzle and flow rate, for a liquid having a viscosity of 65 seconds for a Zahn #2 cup, the breakup point occurred between 10 and 12 cm. below the nozzle over a frequency range between 100 and 400 Hz.

The amplitude of current supplied to the vibrator, and hence the force exerted by the vibrator piston rod, was adjusted at each frequency in the foregoing examples to minimize the breakup point distance below the nozzle. In the case of the 65 seconds viscosity liquid, the current increased from about 0.08 amps at 125 Hz. to 1.24 amps at 400 Hz.

From testing nozzles of the type shown in FIG. 2, having varied nozzle opening sizes, with different viscosity liquids, over a range of frequencies from about 100 Hz. to 500 Hz., the following conclusions were drawn. The flow rate was found to be practically independent of frequency. The amplitude of the vibration has a profound effect on the length of the jet before it starts to break up into droplets. Below a certain minimum amplitude, as measured by the current into the vibrator, the length of jet before breakup increases. Above the optimum point (the shortest jet length), the jet length before breakup increases very slightly with the amplitude of the vibration. When the vibrator current exceeds the optimum point by large amounts, there is a tendency for the jet to become unstable and to splatter. In some cases (notably at lower frequencies), satellite formation (the formation of smaller secondary droplets) is observed when the vibrator is overdriven. For stable results, the best operating amplitude of vibration appears to be just above minimum jet length. This reduces the effects of small changes in viscosity, flow rate, etc. upon droplet formation.

The breakup point is strongly influenced by the viscosity of the fluid: the thicker the fluid, the longer the jet before breakup. It was also found that the thicker the fluid, the greater the current drawn by the vibrator. This increase in current, however, is not large.

The current necessary to obtain the optimum breakup point is highly dependent upon frequency. As the frequency increases, so must the current.

Figure 6:
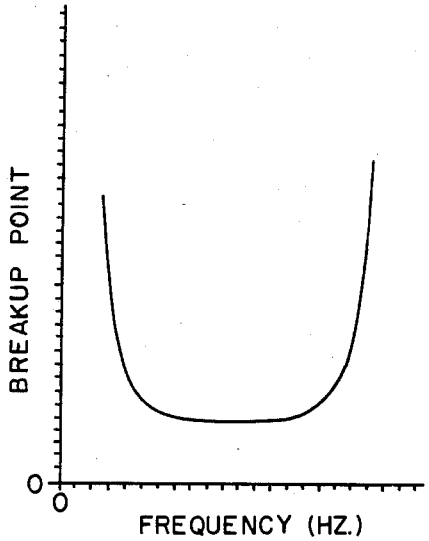
FIG. 6 is a graph qualitatively showing the relationship between the pulsed jet droplet breakup point and the frequency of oscillation of the liquid at the nozzle.

The breakup point versus frequency performance is illustrated diagrammatically in FIG. 6. Generally, there is a frequency band over which the breakup distance is substantially constant. Below or above this band, the breakup length increases rather sharply. The frequency band for the shortest jet length before breakup shifts to lower frequencies as the nozzle diameter increases for a fixed flow rate.

Figure 7:
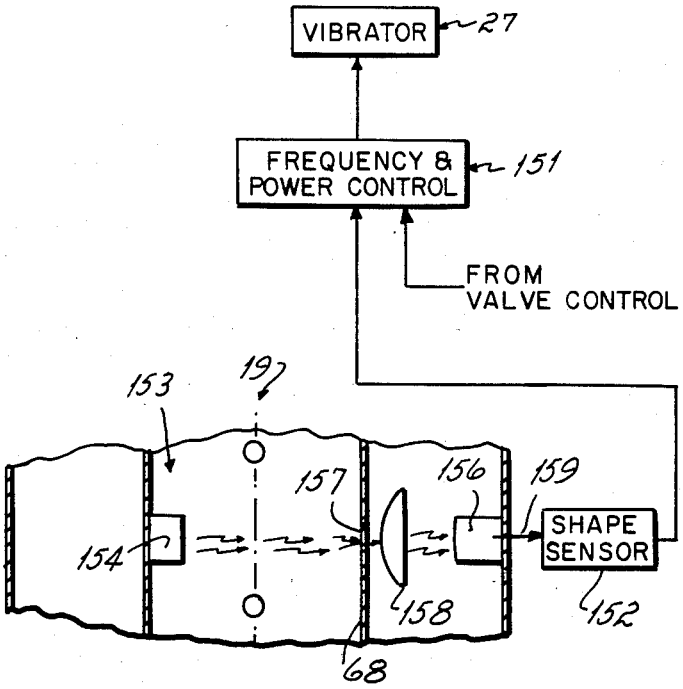
FIG. 7 is a schematic diagram of a nozzle vibrator control system for the embodiments of FIGS. 1 and 3.

With reference now to FIG. 7, a variable control for the vibrator 27 is illustrated. In the figure, a portion of the isolator 11 of FIG. 1 is shown, with the addition of a control 151 for the vibrator 27. In the illustrated form, the vibrator is a Series 100 vibrator produced by Ling Dynamic Systems of Hertfordshire, England. The maximum force and the frequency of the vibrator piston rod is controlled by the frequency and power control 151, which establishes the sinusoidal frequency of the voltage coupled to the vibrator and the amplitude of the voltage. This frequency and voltage may be set by visually observing the droplet stream 19. Such observation of the droplets may be facilitated by using a strobe light slaved to the output frequency of the control 151.

Alternatively, and as illustrated in FIG. 7, a droplet shape sensor 152 provides droplet information to the control 151 from a photosensor arrangement 153. As schematically shown, the photosensor arrangement 153 includes a lightemitting diode (LED) 154 illuminating the droplet path 19 in the splatter shield pipe 68. The light from the LED 154 is received on the other side of the path 19 by a phototransistor 156. A narrow, generally horizontal, slit 157 in the splatter shield pipe 68 permits viewing the droplets in a single plane perpendicular to their direction of motion. This in turn permits diameter sizing of the droplets. A focusing lens 158 focuses the light received through the slit 157 from the LED 154 onto the phototransistor 156. As each droplet moves through the view plane, the light from the LED 154 to the phototransistor 156 is interrupted. As a result, a lightdependent electrical signal is coupled on a line 159 to the shape sensor circuit 152, indicative of light blockage during the passage of a droplet between the LED and the phototransistor, and of light transmission in the intervals between droplets.

The shape sensor 152 may comprise an oscilloscope providing a visual indication of the passage of droplets through the photosensor 153 and permitting manual adjustment of the frequency and power control 151. However, the shape sensor illustrated comprises a control for automatically varying the output of the frequency and power control 151, which is coupled to the vibrator 27, to obtain optimum droplet formation and separation. The frequency and power control is also responsive to the turn-on and turn-off commands from the valve control 93 (FIG. 1).

In one form of the isolator of FIG. 1, flow rates were utilized up to about 350 milliliters per minute. The flow rate is proportional to the vibrator frequency and inversely proportional to the cube of the nozzle diameter. It is presently felt to be desirable to keep the vibration frequency below approximately 500 Hz. to limit piston accelerations and thereby minimize the risk of cavitation in the chamber. Therefore, in order to increase the flow rate, the effective nozzle diameter must increase. At some point, this will require an increase in piston diameter which in turn requires an increase in vibrator size. If practical limits of increasing the nozzle diameter are encountered, other means of increasing the flow rate may be required, such as increasing the number of nozzles in the isolator.

What is claimed is:

1. An isolator for an electrostatic coating system comprising:

a housing;

a receptacle, having an opening in an upper portion thereof and mounted in the housing, for electrostatic coating material which is at a first electrical potential;

an outlet conduit communicating between the receptacle and the exterior of the housing for supplying electrostatic coating material from the receptacle for use by an electrostatic coating device;

a nozzle chamber, for electrostatic coating material at a second electrical potential, mounted above the receptacle and having an aperture in a bottom portion thereof, to serve as a nozzle for dispensing electrostatic coating material;

means for coupling electrostatic coating material to the nozzle chamber from an electrostatic coating material supply;

means for mechanically vibrating the electrostatic coating material in the nozzle chamber to produce a pulsed jet droplet flow of electrostatic coating material in a relatively confined path from the aperture in the bottom portion of the nozzle chamber downwardly into the opening in the upper portion of the receptacle; and an electrostatic shield, at an electrical potential substantially closer to said second electrical potential than to said first electrical potential, mounted between the receptacle and the nozzle chamber to substantially electrically shield the nozzle chamber from electrical potentials below the shield including the electrical potential of the electrostatic coating material in the receptacle, the electrostatic shield having an aperture sized to permit the passage of the pulsed jet droplet flow of electrostatic coating material in a relatively confined path from the nozzle chamber to the receptacle.

2. The isolator of claim 1 in which the nozzle chamber is mounted within the housing above the receptacle.

3. The isolator of claim 2 in which the electrostatic shield is mounted in the housing between the receptacle and the nozzle chamber.

4. The isolator of claim 3 in which the second electrical potential of the electrostatic coating material in the nozzle chamber is a ground potential.

5. The isolator of claim 4 in which the electrostatic shield is at a ground potential.

6. The isolator of claim 5 in which the housing in the vicinity of the nozzle chamber, for electrostatic coating material at a ground potential, is electrically conductive and at a ground potential.

7. The isolator of claim 5 in which the housing is substantially electrically conductive and at a ground potential.

8. The isolator of claim 1 in which the second electrical potential of the electrostatic coating material in the nozzle chamber is a ground potential.

9. The isolator of claim 8 in which the electrostatic shield is at a ground potential.

10. The isolator of claim 1 in which the receptacle comprises a generally rounded exterior wall.

11. The isolator of claim 10 in which the receptacle further comprises a coating material cup mounted in the rounded exterior wall.

12. The isolator of claim 11 in which the receptacle further comprises a funnel having an angled sidewall beneath the opening in the upper portion of the receptacle for receiving said pulsed jet droplet flow.

13. The isolator of claim 11 in which the opening in the upper portion of the receptacle is smaller than the surface area of coating material in the cup.

14. The isolator of claim 1 in which the nozzle chamber, mounted above the receptacle, has an aperture in a bottom portion thereof which is a nozzle aperture.

15. The isolator of claim 14 in which the means for coupling the electrostatic coating material supply to the nozzle chamber comprises a bore in a wall of the nozzle chamber.

16. The isolator of claim 1 in which the means for mechanically vibrating the electrostatic coating material comprises means for producing oscillatory pressure changes at the aperture in the bottom portion of the nozzle chamber.

17. The isolator of claim 16 in which the means for mechanically vibrating the electrostatic coating material further comprises a diaphragm forming one wall of the nozzle chamber.

18. The isolator of claim 17 in which the means for mechanically vibrating the electrostatic coating material further comprises a piston attached to the diaphragm and movable within the nozzle chamber.

19. The isolator of claim 18 in which the nozzle chamber, mounted above the receptacle, has an aperture in a bottom portion thereof which is a nozzle aperture.

20. The isolator of claim 19 in which the means for coupling the electrostatic coating material supply to the nozzle chamber comprises a bore in a wall of the nozzle chamber.

21. The isolator of claim 20 in which the piston is reciprocable in the nozzle chamber and operable to cover and uncover the bore in the nozzle chamber.

22. The isolator of claim 1 in which the means for mechanically vibrating the electrostatic coating material in the nozzle chamber comprises a diaphragm forming a top wall of the nozzle chamber and a vibrator coupled to the diaphragm mounted above the nozzle chamber for driving the diaphragm to produce oscillatory pressure changes in the nozzle chamber.

23. The isolator of claim 22 which further comprises means for varying the frequency of vibration of the vibrator.

24. The isolator of claim 22 which further comprises means for varying the force applied to the membrane by the vibrator.

25. The isolator of claim 24 which further comprises means for varying the frequency of vibration of the diaphragm by the vibrator.

26. The isolator of claim 22 in which the nozzle chamber is mounted within the housing above the receptacle.

27. The isolator of claim 26 in which the second electrical potential of the electrostatic coating material in the nozzle chamber is a ground potential.

28. The isolator of claim 27 in which the housing further comprises a lid at the top of the housing, beneath which the vibrator and the nozzle chamber are mounted.

29. The isolator of claim 1 which further comprises means for sensing droplet separation in the pulsed jet droplet flow at a location between the receptacle and the nozzle chamber and means responsive to the sensed separation for controlling the means for mechanically vibrating the electrostatic coating material in the nozzle chamber.

30. The isolator of claim 29 in which the means for mechanically vibrating the electrostatic coating material in the nozzle chamber comprises a diaphragm forming a top wall of the nozzle chamber and a vibrator coupled to the diaphragm mounted above the nozzle chamber for driving the diaphragm to produce oscillatory pressure changes in the nozzle chamber.

31. The isolator of claim 30 which further comprises means for varying the force applied to the membrane by the vibrator.

32. The isolator of claim 31 which further comprises means for varying the frequency of vibration of the diaphragm by the vibrator.

33. The isolator of claim 32 in which the means for controlling the means for mechanically vibrating the electrostatic coating material in the nozzle chamber comprises means for controlling the frequency and force of vibration of the vibrator.

34. The isolator of claim 29 in which the means for sensing the droplet separation location comprises a photosensor arrangement positioned along the pulsed jet droplet flow path.

35. The isolator of claim 34 in which the photosensor arrangement comprises a light source directing light through the path of the pulsed jet droplet flow and a light sensitive device on an opposite side of the path for receiving light from the light source, interrupted by droplet flow in the path.

36. The isolator of claim 35 in which the light sensitive device produces an electrical signal indicative of the light received from the light source and further comprising means for controlling the frequency and force of the vibrator utilizing said electrical signal.

37. The isolator of claim 36 which further comprises a light-focusing lens positioned between the pulsed jet droplet flow path and the light sensitive device for focusing light upon the light sensitive device.

38. The isolator of claim 37 which further comprises means for defining a narrow slit transverse to the path of the pulsed jet droplet flow at a location between the flow path and the focusing lens.

39. The isolator of claim 1 which further comprises a coating material collection bowl mounted above the electrostatic shield and below the nozzle chamber, for collecting splattered coating material from the aperture in the bottom portion of the nozzle chamber, the bowl being apertured in line with an aperture in the apertured electrostatic shield to permit passage of the pulsed jet droplet flow through the bowl.

40. The isolator of claim 39 further comprising a vertical pipe extending above the bowl about the aperture, positioned to receive the pulsed jet droplet flow from the nozzle chamber.

41. The isolator of claim 40 in which the aperture in the bowl is no larger than said in line aperture in the electrostatic shield.

42. The isolator of claim 41 in which the pipe on the bowl surrounding the pulsed jet droplet flow path further includes, in its interior, an inverted frusto-conical element in the form of a funnel having an opening in a lower portion thereof for the pulsed jet droplet flow path which is smaller than said apertures in the bowl and in the electrostatic shield.

43. The isolator of claim 1 in which the nozzle chamber, mounted above the receptacle, has an aperture in a bottom portion thereof which is a nozzle aperture, and the means for coupling electrostatic coating material to the nozzle chamber comprises a manifold surrounding the nozzle chamber and communicating therewith through a plurality of radial bores between the manifold and the chamber.

44. An electrostatic coating system including a source of electrically conductive coating material at a ground potential, an electrostatic coating dispensing device for dispensing electrically conductive coating material onto objects to be coated, means for electrostatically charging the coating material dispensed by the dispensing device to a high electrostatic potential, and an isolator for coupling electrically conductive coating material from the coating material source to the coating material dispensing device while maintaining electrical isolation therebetween, the isolator comprising:

a housing;

a charged coating material receptacle having an opening in an upper portion thereof and mounted in the housing;

means for coupling coating material from the charged coating material receptacle through the housing to the coating material dispensing device, whereby electrically conductive coating material in the receptacle is electrostatically charged by the charging means through the conductive coating material in the coupling means;

a grounded coating material nozzle chamber mounted above the charged coating material receptacle and having an aperture in a bottom portion thereof defining a coating material nozzle;

means for coupling coating material from the source of coating material to the grounded coating material nozzle chamber;

means for mechanically vibrating the coating material in the grounded coating material nozzle chamber to produce a pulsed jet droplet flow of coating material in a relatively confined path from the aperture in the bottom portion of the grounded nozzle chamber downwardly into the opening in the upper portion of the charged coating material receptacle; and a grounded electrostatic shield mounted between the receptacle and the nozzle chamber to substantially shield the grounded coating material nozzle chamber from electrical potentials below the shield including the electrical potential of the charged coating material in the charge coating material receptacle, the electrostatic shield having an aperture sized to permit pulsed jet droplet flow of coating material in a relatively confined path from the grounded coating material nozzle chamber into the charged coating material receptacle.

45. The coating system of claim 44 in which the grounded coating material nozzle chamber is mounted within the housing above the charged coating material receptacle.

46. The coating system of claim 44 in which the grounded coating material nozzle chamber, mounted above the charged coating material receptacle, has an aperture in a bottom portion thereof which is a nozzle aperture.

47. The coating system of claim 46 in which the means for coupling electrostatic coating material from the source of coating material to the grounded coating material nozzle chamber comprises a bore in a wall of the nozzle chamber.

48. The coating system of claim 44 in which the means for mechanically vibrating the electrostatic coating material comprises means for producing oscillatory pressure changes at the aperture in the bottom portion of the grounded coating material nozzle chamber.

49. The coating system of claim 48 in which the means for mechanically vibrating the electrostatic coating material further comprises a diaphragm forming one wall of the grounded coating material nozzle chamber.

50. The coating system of claim 44 in which the means for mechanically vibrating the coating material in the grounded coating material nozzle chamber comprises a diaphragm forming a top wall of the grounded coating material nozzle chamber and a vibrator coupled to the diaphragm mounted above the grounded coating material nozzle chamber for driving the diaphragm to produce oscillatory pressure changes in the grounded coating material nozzle chamber.

51. The coating system of claim 44 which further comprises means for sensing droplet separation in the pulsed jet droplet flow at a location between the charged coating material receptacle and the grounded coating material nozzle chamber and means responsive to the sensed separation for controlling the means for mechanically vibrating the coating material in the grounded coating material nozzle chamber.

52. The coating system of claim 44 which further comprises a coating material collection bowl mounted above the electrostatic shield and below the grounded coating material nozzle chamber, for collecting splattered coating material from the aperture in the bottom portion of the grounded coating material nozzle chamber, the bowl having an aperture in line with an aperture in the apertured electrostatic shield to permit passage of the pulsed jet droplet flow through the bowl.

53. The coating system of claim 52 further comprising a vertical pipe extending above the bowl about the bowl aperture, positioned to receive the pulsed jet droplet flow from the grounded coating material nozzle chamber.

54. The coating system of claim 44 in which the grounded coating material nozzle chamber, mounted above the charged coating material receptacle, has an aperture in a bottom portion thereof which is a nozzle aperture, and the means for coupling coating material from the source of coating material to the grounded coating material nozzle chamber comprises a manifold surrounding the nozzle chamber and communicating therewith through a plurality of radial bores between the manifold and the chamber.

55. An isolator for an electrostatic coating system comprising:

a housing;

a receptacle, having an opening in an upper portion thereof and mounted in the housing, for electrostatic coating material which is at a first electrical potential;

an outlet conduit communicating between the receptacle and the exterior of the housing for supplying electrostatic coating material from the receptacle for use by an electrostatic coating device;

droplet supply means for supplying droplets of coating material at a second electrostatic potential at a location spaced above said receptacle for downward flow into said opening in the upper portion of said receptacle, and an electrostatic shield at an electrical potential substantially closer to said second potential than to said first potential, mounted between said droplet supply means and said receptacle opening to substantially electrostatically shield said droplet supply means from electrostatic potentials below said shield including the electrostatic potential of the coating material in said receptacle.

56. The isolator of claim 55 wherein said droplet supply means includes:

a nozzle chamber, for electrostatic coating material at a second electrical potential, mounted above the receptable and having an aperture in a bottom portion thereof, to serve as a nozzle for dispensing electrostatic coating material, means for coupling electrostatic coating material to the nozzle chamber from an electrostatic coating material supply, and means for mechanically vibrating the electrostatic coating material in the nozzle chamber to produce a pulsed jet droplet flow of electrostatic coating material from the aperture in the bottom portion of the nozzle chamber into the opening in the upper portion of the receptacle, said means for mechanically vibrating the electrostatic coating material including means for producing oscillatory pressure changes at the aperture in the bottom portion of the nozzle chamber.

57. The isolator of claim 56 in which the means for mechanically vibrating the electrostatic coating material further comprises a diaphragm forming one wall of the nozzle chamber.

58. The isolator of claim 57 in which the means for mechanically vibrating the electrostatic coating material further comprises a piston attached to the diaphragm and movable within the nozzle chamber.

59. The isolator of claim 58 in which the nozzle chamber, mounted above the receptacle, has an aperture in a bottom portion thereof which is a nozzle aperture.

60. The isolator of claim 59 in which the means for coupling electrostatic coating material from the coating material supply to the nozzle chamber comprises a bore in a wall of the nozzle chamber.

61. The isolator of claim 60 in which the piston is reciprocable in the nozzle chamber and operable to cover and uncover the bore in the nozzle chamber.

62. The isolator of claim 56 in which the means for mechanically vibrating the electrostatic coating material in the nozzle chamber comprises a diaphragm forming a top wall of the nozzle chamber and a vibrator coupled to the diaphragm mounted above the nozzle chamber for driving the diaphragm to produce oscillatory pressure changes in the nozzle chamber.

63. The isolator of claim 62 which further comprises means for varying the frequency of vibration of the vibrator.

64. The isolator of claim 62 which further comprises means for varying the force applied to the membrane by the vibrator.

65. THe isolator of claim 55 which further comprises means for sensing droplet separation in the pulsed jet droplet flow at a location between the receptacle and the droplet supply means, and means responsive to the sensed separation for controlling the droplet supply means to regulate the droplet separation.

66. The isolator of claim 65 wherein said droplet supply means includes:

a nozzle chamber, for electrostatic coating material at a second electrical potential, mounted above the receptacle and having an aperture in a bottom portion thereof, to serve as a nozzle for dispensing electrostatic coating material, means for coupling electrostatic coating material to the nozzle chamber from an electrostatic coating material supply, means for mechanically vibrating the electrostatic coating material in the nozzle chamber to produce a pulsed jet droplet flow of electrostatic coating material from the aperture in the bottom portion of the nozzle chamber into the opening in the upper portion of the receptacle, and said means for mechanically vibrating the electrostatic coating material in the nozzle chamber comprises a diaphragm forming a top wall of the nozzle chamber and a vibrator coupled to the diaphragm mounted above the nozzle chamber for driving the diaphragm to produce oscillatory pressure changes in the nozzle chamber.

67. The isolator of claim 66 which further comprises means for varying the force applied to the diaphragm by the vibrator.

68. The isolator of claim 67 which further comprises means for varying the frequency of vibration of the diaphragm by the vibrator.

69. The isolator of claim 68 in which the means for controlling the means for mechanically vibrating the electrostatic coating material in the nozzle chamber comprises means for controlling the frequency and force of vibration of the vibrator.

70. An isolator for an electrostatic coating system comprising:

a housing;

a receptacle, having an opening in an upper portion thereof and mounted in the housing, for electrostatic coating material which is at a first electrical potential;

an outlet conduit communicating between the receptacle and the exterior of the housing for supplying electrostatic coating material from the receptacle for use by an electrostatic coating device;

a nozzle chamber, for electrostatic coating material at a second electrical potential, mounted above the receptacle and having an aperture in a bottom portion thereof, to serve as a nozzle for dispensing electrostatic coating material;

means for coupling electrostatic coating material to the nozzle chamber from an electrostatic coating material supply;

means for forming coating material dispensed from the aperture in the bottom portion of the nozzle chamber into discrete droplets falling downwardly in a relatively confined path; and an electrostatic shield, at an electrical potential substantially closer to said second electrical potential than to said first electrical potential, mounted between the receptacle and the nozzle chamber to substantially electrically shield an area below the nozzle chamber in which said discrete droplets are formed from electrical potentials below the shield including the electrical potential of the electrostatic coating material in the receptacle, the electrostatic shield having an aperture sized to permit the passage of electrostatic coating material in a relatively confined path from the nozzle chamber to the receptacle.

71. The isolator of claim 70 in which the nozzle chamber is mounted within the housing above the receptacle.

72. The isolator of claim 71 in which the electrostatic shield is mounted in the housing between the receptacle and the nozzle chamber.

73. The isolator of claim 72 in which the second electrical potential of the electrostatic coating material in the nozzle chamber is a ground potential.

74. The isolator of claim 73 in which the electrostatic shield is at a ground potential.

75. The isolator of claim 70 which further comprises a coating material collection bowl mounted above the electrostatic shield and below the nozzle chamber, for collecting splattered coating material from the aperture in the bottom portion of the nozzle chamber, the bowl having an aperture in line with an aperture in the apertured electrostatic shield to permit passage of the droplets through the bowl.

76. The isolator of claim 75 further comprising a vertical pipe extending above the bowl about the bowl aperture, positioned to receive the droplet flow from the nozzle chamber.

77. An isolator for transferring liquid from a first quantity of liquid at a first electrostatic potential to a second quantity of liquid at a second electrostatic potential, different from said first potential, comprising:

a receptacle for said second quantity of liquid, having an opening in an upper portion thereof;

an outlet conduit coupled from the receptacle for the second quantity of liquid to a use location for said liquid;

droplet supply means for supplying in a relatively confined downward flow path, droplets of coating material at a first electrostatic potential at a location spaced above said receptacle for flow into said opening in the upper portion of said receptacle, and an electrostatic shield at an electrical potential substantially closer to said first potential than to said second potential, mounted between said droplet supply means and said receptacle opening to substantially electrostatically shield said droplet supply means from electrostatic potential below said shield including the electrostatic potential of the coating material in said receptacle, said electrostatic shield having an aperture sized to permit the passage of said droplets in said relatively confined flow path from said droplet supply means to said receptacle.

78. An isolator for transferring liquid from a first quantity of liquid at a first electrostatic potential to a second quantity of liquid at a second electrostatic potential, different from said first potential, comprising:

a receptacle for said second quantity of liquid, having an opening in an upper portion thereof;

an outlet conduit coupled from the receptacle for the second quantity of liquid to a use location for said liquid;

a nozzle chamber for the first quantity of liquid, mounted above the receptacle for the second quantity of liquid and having an aperture in a bottom portion thereof, to serve as a nozzle for dispensing liquid;

means for coupling liquid to the nozzle chamber for the first quantity of liquid from a liquid supply;

means for forming the liquid dispensed from the nozzle chamber for the first quantity of liquid into discrete droplets falling downwardly in a relatively confined path; and an electrostatic shield, at an electrical potential substantially closer to the electrical potential of the first quantity of liquid than to the electrical potential of the second quantity of liquid, mounted between the receptacle and the nozzle chamber at a location to substantially electrically shield areas of droplet formation beneath the nozzle chamber for the first quantity of liquid from electrical potentials below the shield, including the electrical potential of the second quantity of liquid, the electrostatic shield having an aperture sized to permit the passage of liquid droplets from the first quantity of liquid in a relatively confined path to the second quantity of liquid.

79. An isolator for transferring liquid from a first quantity of liquid at a first electrostatic potential to a second quantity of liquid at a second electrostatic potential, different from said first potential, comprising:

a receptacle for said second quantity of liquid, having an opening in an upper portion thereof;

a nozzle chamber for the first quantity of liquid, mounted above the receptacle for the second quantity of liquid and having an aperture in a bottom portion thereof, to serve as a nozzle for dispening liquid;

means for mechanically vibrating the first quantity of liquid to produce a pulsed jet droplet flow of liquid in a relatively confined path, from the aperture in the bottom portion of the nozzle chamber for the first quality of liquid, downwardly into the opening in the upper portion of the receptacle for the second quantity of liquid; and an electrostatic shield, at an electrical potential substantially closer to the electrical potential of the first quantity of liquid than to the electrical potential of the second quantity of liquid, mounted between the receptacle and the nozzle chamber at a location to substantially electrically shield locations of droplet formation beneath the nozzle chamber for the first quantity of liquid from electrical potentials below the shield including the electrical potential of the second quantity of liquid, the electrostatic shield having an aperture sized to permit the passage of liquid droplets from the first quantity of liquid in a relatively confined path to the second quantity of liquid.

80. A method of transferring liquid from a source of liquid at a first electrostatic potential to a supply of liquid at a second electrostatic potential, different from said first potential, comprising the steps of:

forming liquid supplied from the source at the first electrostatic potential into droplets at a predetermined location for establishing a downward droplet flow therefrom, collecting the droplets of liquid in the droplet flow in a receptacle, mounted below the predetermined location, having an opening in an upper portion thereof for receiving said droplets;

electrostatically shielding the predetermined location from the liquid collected in the receptacle to substantially prevent electrostatic charging of the droplets formed at said predetermined location while permitting the droplets to flow downwardly for collection in the receptacle with an electrostatic shield between the predetermined location and the receptacle, and coupling liquid collected in said receptacle to the liquid supply at the second potential.

81. A method of transferring liquid from a source of liquid at a first electrostatic potential to a supply of liquid at a second electrostatic potential, different from said first potential, comprising the steps of:

coupling liquid from the source to a chamber having an aperture in a bottom portion thereof;

dispensing liquid in the chamber to form discrete droplets of liquid falling downwardly in a relatively confined path beneath the chamber;

electrostatically shielding areas of droplet formation below the chamber to substantially prevent induction charging of the droplets at formation while permitting the passage of droplets falling downwardly in a relatively confined path;

collecting the droplets in a receptacle, mounted below the chamber, having an opening in an upper portion thereof for receiving said droplets; and coupling liquid collected in said receptacle to the liquid supply.

82. A method of transferring liquid from a source of liquid at a first electrostatic potential to a supply of liquid at a second electrostatic potential, different from said first potential, comprising the steps of:

forming liquid supplied from the source at the first electrostatic potential into droplets at a predetermined location for establishing a downward droplet flow therefrom, sensing droplet separation at a location below the predetermined location;

controlling the droplet formation at the predetermined location dependent upon the sensed separation of the droplets being sensed below the predetermined location;

collecting the droplets in a receptacle, mounted below the chamber, having an opening in an upper portion thereof for receiving said droplets;

electrostatically shielding the predetermined location from the liquid collected in the receptacle to substantially prevent electrostatic charging of the droplets formed at said predetermined location while permitting the droplets to flow downwardly for collection in the receptacle with an electrostatic shield between the predetermined location and the receptacle, and coupling liquid collected in the receptacle to the liquid supply at the second potential.

* * * * *